United States Patent [19]

Kleef et al.

[11] 4,087,082

[45] May 2, 1978

[54] DEVICE FOR EXCHANGING AND/OR REPAIRING THE DOWN SPOUT AND SEATING BRICK IN A STEEL LADLE

[75] Inventors: Jan A. Kleef; Sytze M. Doorenbos, both of Beverwijk, Netherlands

[73] Assignee: Hoogovens Ijmuiden, B.V., Ijmuiden, Netherlands

[21] Appl. No.: 797,531

[22] Filed: May 16, 1977

[30] Foreign Application Priority Data

May 25, 1976 Netherlands ..... 7605585

[51] Int. Cl.[2] ..... C21C 1/00

[52] U.S. Cl. ..... 266/281; 266/287

[58] Field of Search ..... 266/281, 287, 142, 143

[56] References Cited

U.S. PATENT DOCUMENTS 3,860,060 1/1975 Reighart ..... 266/287

*Primary Examiner*—Gerald A. Dost

*Attorney, Agent, or Firm*—Stevens, Davis, Miller & Mosher

[57] ABSTRACT

A device for exchanging the down spout and repairing a seating brick in a steel ladle, comprising a vertically movable cage, a hoist system therefore and a carriage for transferring the ladle along a fixed track. The carriage is adapted to hold the ladle with the radial direction of the bottom of the ladle towards the down spout at an acute angle to the direction of transfer. Above the path of the upper rim of the ladle, a platform is provided, and further a tower construction is displaceable on the platform in the radial direction towards the down spout. The cage is hoistable inside the tower construction by means of hoisting means connected to the tower construction. In a preferred embodiment the cage consists of a substantially cylindrical insulated wall and of a bottom cooled by flushing with air. A ventilation system, a travelling crab, an operating hatch in the cage wall and a special recessed shape of the cage may facilitate operation. A further improvement may be obtained by the provision of a resiliently mounted pushing device for pushing the down spout out.

4 Claims, 4 Drawing Figures

DEVICE FOR EXCHANGING AND/OR REPAIRING THE DOWN SPOUT AND SEATING BRICK IN A STEEL LADLE

The invention relates to a device for exchanging the down spout and repairing the seating brick in a steel ladle, comprising a vertically movable cage and a hoist-system therefor. With a known device of such a type, the aim is to change a worn out down spout of a teeming ladle, or to repair the seating brick in which this down spout is fitted, without the ladle having to be cooled down. For, by exchanging the down spout while the ladle is hot, the availability of the ladle is considerably increased. As, however, such a repair is to be performed from within the ladle, which may still have a temperature of about 1000° C, special provisions are necessary in order to protect the people doing this from too intensive heat-radiation. In the known device, these provisions consist in that a closed metal cage which mainly absorbs the heat radiation is used and that the repair job is performed sufficiently fast so that the temperature inside the cage cannot increase intolerably.

In order to increase safety for the operators, and also in order that the repair job is performed more accurately, there is sought a construction of the device which satisfies these conditions. The invention consists in that the known device further comprises a carriage for transferring the ladle along a fixed track, and carriage being suitable to hold the ladle in a position with the radial direction of the bottom [of the ladle] towards the down spout at an acute angle to the direction of transfer, a platform above the path of the upper rim of the ladle, a tower construction which is displaceable on the said platform in the radial direction towards the down spout, the cage being hoistable inside the tower construction by means of hoisting means connected to said tower construction. This new device has made it possible to bring the cage more quickly and more reliably into and out of the position in which operations are to be performed on the down spout and the seating brick. This minimizes the time during which the cage may be heated by radiation from the ladle wall but during which the actual repair is not taking place.

In steel ladles which are provided with an interchangeable stopper rod which is connected to a movable stopper rod holder, the stopper rod holder with the stopper rod, and hence also the down spout, are as a rule arranged at a sharp angle of about 45° with respect to the axis of the trunnions of the ladle. Before work can be done at the down spout and the seating brick, the stopper rod is to be removed. By means of the new construction the demounting of the stopper rod may be performed from within the cage, for which purpose, however, the said cage has first to be lowered to beside the stopper rod. After dismantling of the stopper rod, the cage with the tower construction has to be displaced to above the down spout. As the cage is hoistable from a tower construction, which is displaceable on a platform in the radial direction towards the down spout it was found possible to position the cage correctly above the down spout very quickly.

A further improvement of the device may be obtained if the cage consists of a substantially cylindrical insulated wall and of a bottom cooled by flushing with air, with a hatch in the bottom which is above the down spout in the operating position, the cage further being provided with an air-ventilation system which opens near the bottom, a travelling crab above the bottom hatch, and an entrance door in the wall near the bottom. Because of the bottom cooling and the ventilation system the operators' space inside the cage may be kept at a temperature which is suitable for the performance of repair jobs, even if the cage is to stay inside the ladle for a relatively long time.

In the elevated position of the cage, the operators may enter the cage from the platform through the entrance door. Repair material and tools may also be supplied by this route.

It is preferred that the entrance door is secured by electrical means in every position of the cage except the upper position. By means of the movable crab, the spout and the tools may be brought to a position just above the seating brick, and may from there be moved vertically.

In order that the stopper rod may also be demounted, a construction of the device according to the invention is preferred in which, about opposite the entrance door at working height, an operating hatch is provided in the cage wall for demounting the stopper rod, and in which the cage has a recess above the operating cover. This recess should be sufficiently deep and high in order that the cage may move to a position above the teeming hole without hindrance by the stopper rod holder.

In order to remove the spout, it is possible to loosen it by pushing from beneath before the ladle is brought into its working position, whereupon this spout then may be removed from inside the cage. A construction of the device according to the invention is preferred however in which beneath the path of the ladle carriage, near the tapping hole in the operating position, there is provided an elastically mounted pushing device for pushing the down spout out, which may be positioned in two directions and which preferably may be operated from within the cage.

The invention will now be illustrated with reference to four figures.

Figure 1:
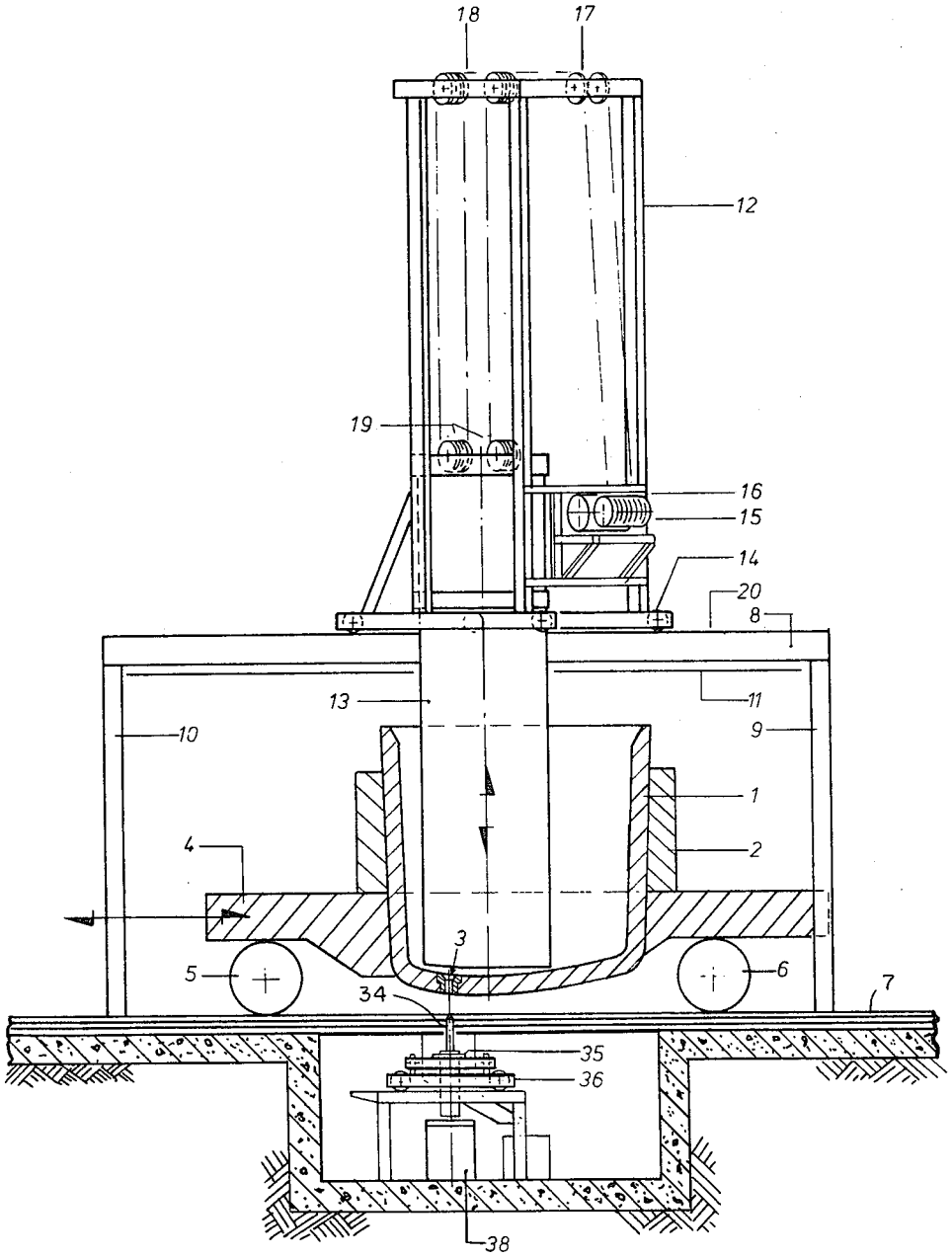
FIG. 1 shows a general view of the installation.
Figure 2:
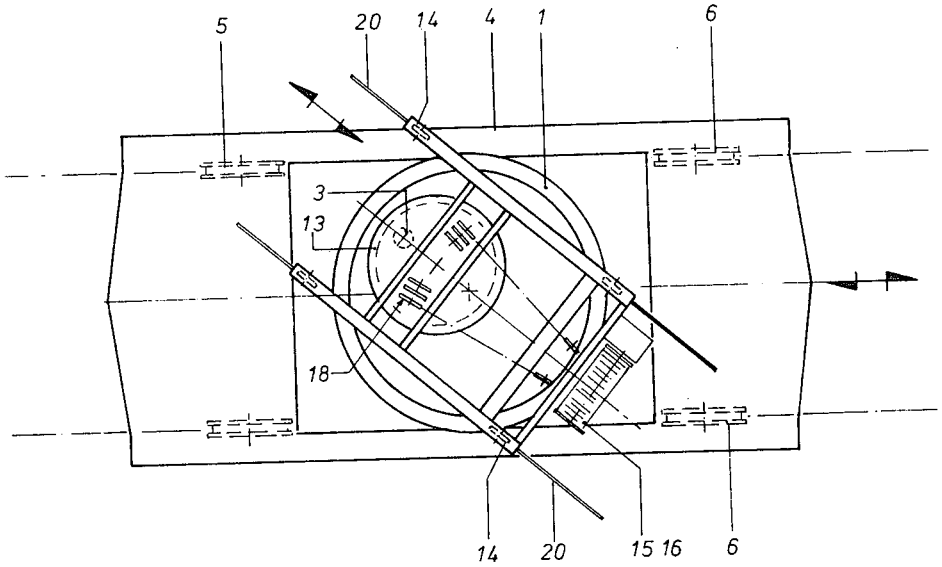
FIG. 2 shows a view from above of part of the installation according to FIG. 1.

In FIG. 1, reference numeral 1 indicates a refractory lined ladle for teeming steel which is provided with a ring 2. In the bottom of the ladle there is a seating brick with a down spout 3. If this down spout is worn out, it is to be removed upwardly from the ladle and replaced by a new one. It is often also necessary to repair wear which occurs to the seating brick by applying a refractory mass. By means of ring 2 the ladle rests in a frame 4 of a carriage which may be transferred along rails 7 on wheels 5 and 6 in the direction indicated by the arrow. Carriage 4 may be moved under a structure which consists of a platform 8 and support members 9 and 10. A heat shield 11 is provided under the platform 8. A tower construction 12 can travel across the platform 8 at an angle of about 45° to the direction of the axis of the carriage 4 (see FIG. 2). A cage 13 is hoistable vertically inside the tower, for which purpose this cage moves along guides (not indicated). The tower is movable by means of wheels 14 on rails 20. A combination consisting of an electric motor 15 and a winch 16 is connected to the tower, which makes it possible to wind and unwind cables which are led around rollers 17 and around pulleys in pulley boxes 18 and 19, respectively connected to the tower and to the cage.

FIG. 1 further shows a device underneath a rail track 7 for removing the down spout by pressing. This device comprises a ram 34 which may be moved by a cylinder, which itself may be lifted hydraulically in order to loosen the down spout. This ram construction is positioned on a resilient element, which may itself be positioned with respect to the foundation 38 by means of two movable supports 35 and 36 which are movable in two mutually perpendicular directions. Not shown are those tools which without explanation will be understood to be provided for lifting the loosened down spout and for replacing it by a new one.

Figure 3:
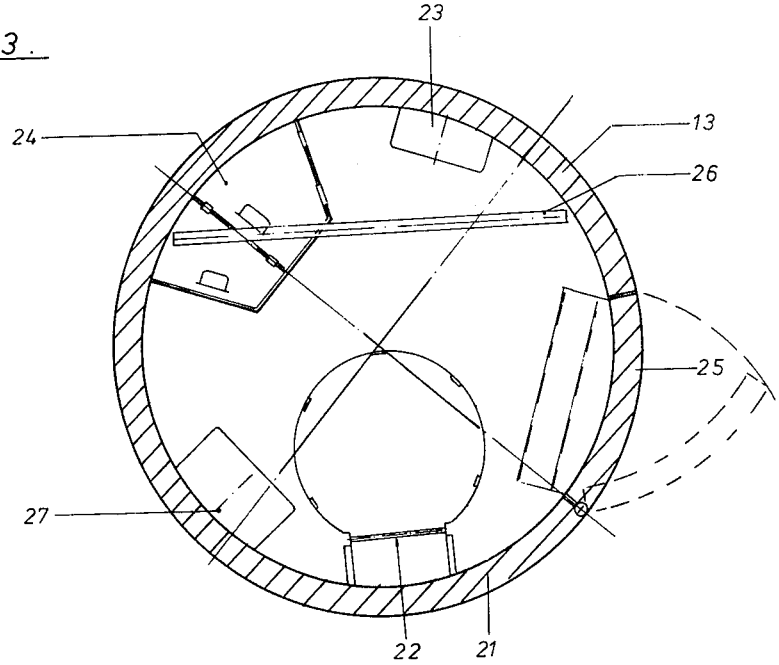
FIG. 3 shows a crosssection through the cage.
Figure 4:
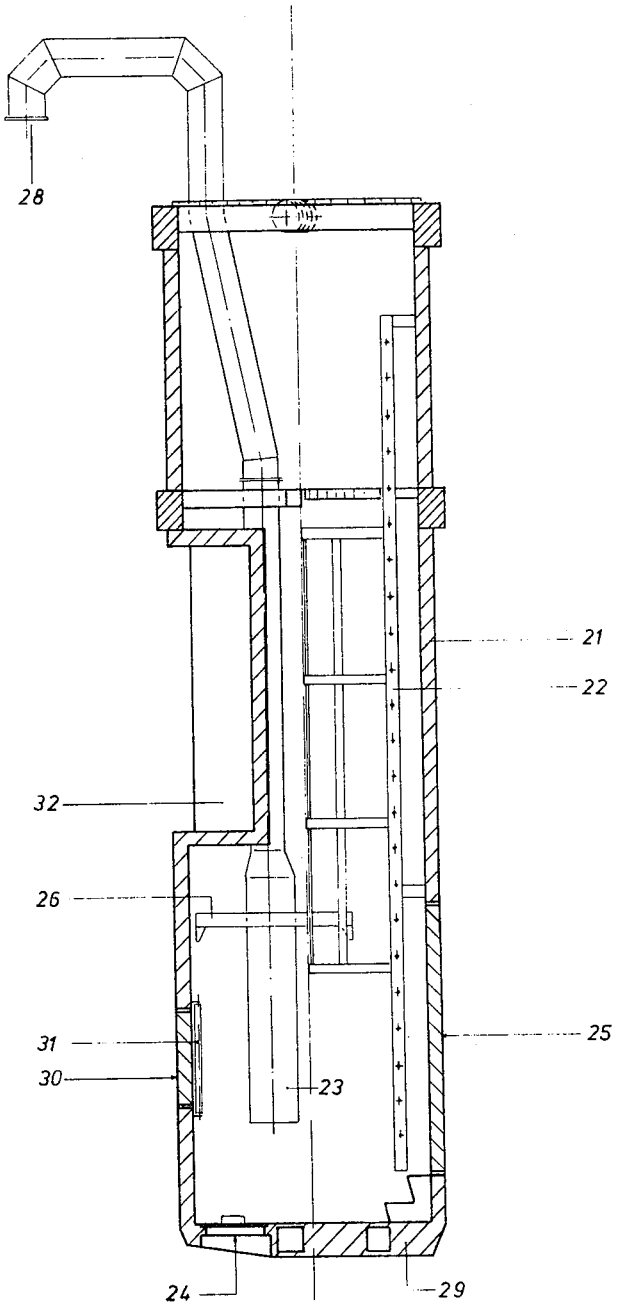
FIG. 4 is a longitudinal section through the cage.

In FIG. 3 the cage has been shown in cross section and in FIG. 4 in longitudinal section. Inside a shell 21 a ladder 22 is provided. Also a ventilation system 23 from outside the cage debouches near the bottom.

The bottom hatch 24 consists of two parts which may be swung around hinges with the use of handgrips. An opening is thereby made free which is sufficiently large to permit manipulation at and near the down spout and the seating brick. A door 25 is provided inside the cage near the bottom. (Also see FIG. 4).

A travelling crab 26 runs transversely through the cage to above the hatch 24. At working height above the bottom cover 24 a further hatch 30 is provided in the side wall. This hatch 30 can be swung around hinge 31 towards the inside in such a way that its hot face remains directed outwardly. In the hoisted position of the cage, the door 25 is at the same level as platform 8, permitting repair material, tools and down spout to be carried across the platform and through the door 25 into the interior of the cage. Inside the cage, use can then be made of the travelling crab 26. During repair jobs the door 25 remains secured.

FIG. 3 also schematically shows a control pole 27 which permits control from within the cage of the displacement of the cage vertically inside tower 12 and of the tower 12 itself in a horizontal direction. With this it is also possible to position and operate a ramming mechanism 34, 35. It will be clear that the necessary control movements are possible with pre-programmed limit switches and also with the help of visual observation through the bottom hatch.

In emergencies the cage can also be controlled from the platform for hoisting and travelling movements, and the ramming mechanism can be controlled from the pit. The cage may then possibly be left or entered via ladder 22. The cooling air which flows from ventilation shaft 23 is supplied via conduit 28, which is coupled by flexible means to a fan in such a way that the connection remains complete even when the cage is hoisted. By means of a conduit for compressed air (not indicated) the hollow bottom 29 is flushed separately with cooling air. For that purpose this bottom 29 is constructed as a system of channels in such a way that the compressed flushing air cools the bottom in the optimal way. Finally the cooling air which has passed through the bottom is carried away outwardly. In an intermediate position of cage 13 the hatch 31 may be opened to permit dis-connection of the stopper rod from the stopper rod holder. Upon further descent, the cage may then be moved to closely above the down spout without contact of the cage with the stopper rod holder (not indicated), because of the recess 32.

We claim:

1. Device for exchanging the down spout and repairing a seating brick in a steel ladle, comprising a vertically movable cage and a hoist system therefore, characterized in that the device further comprises a carriage for transferring the ladle along a fixed track, the carriage being adapted to hold the ladle with the radial direction of the bottom towards the down spout at an acute angle to the direction of transfer, a platform above the path of the upper rim of the ladle, a tower construction which is displaceable on the said platform in the radial direction towards the down spout, the cage being hoistable inside the tower construction by means of hoisting means connected to said tower construction.

2. Device according to claim 1, characterized in that the cage consists of a substantially cylindrical insulated wall and of a bottom cooled by flushing with air, with a hatch in the bottom which is above the down spout in the operating position, the cage further being provided with an air ventilation system which opens near the bottom, a travelling crab above the bottom cover, and an entrance door in the wall near the bottom.

3. Device according to claim 2, characterized in that about opposite the entrance door at working height, there is provided an operating hatch in the cage wall for demounting of the stopper rod, and in that the cage has a recess above the operating hatch.

4. Device according to claim 1, characterized in that, beneath the path of the ladle carriage and near the tapping hole in the operating position, there is provided a resiliently mounted pushing device for pushing the down spout out, which can be positioned in two different directions and which preferably can be operated from within the cage.

* * * * *